US008418274B2

(12) United States Patent
Dodson

(10) Patent No.: US 8,418,274 B2
(45) Date of Patent: Apr. 16, 2013

(54) VACUUM DRAINAGE SYSTEM FOR UNCLOGGING A CLOGGED DRAIN, DRAIN CLEAN-OUT DEVICE THEREFOR, AND METHOD OF UNCLOGGING A CLOGGED DRAIN

(75) Inventor: Larry Edward Dodson, Lewistown, PA (US)

(73) Assignees: Cindy White, Lewistown, PA (US); Rosalee Dodson, Lewistown, PA (US)

( * ) Notice: Subject to any disclaimer, the term of this patent is extended or adjusted under 35 U.S.C. 154(b) by 1467 days.

(21) Appl. No.: 11/982,221

(22) Filed: Nov. 1, 2007

(65) Prior Publication Data

US 2009/0113612 A1 May 7, 2009

(51) Int. Cl.
*E03D 9/00* (2006.01)
*B08B 5/04* (2006.01)

(52) U.S. Cl.
USPC ..... 4/255.01; 4/255.08; 4/255.04; 4/255.11; 134/21; 15/304; 15/353

(58) Field of Classification Search ..... 15/304, 15/353, 15; 4/255.01, 255.05; 134/21
See application file for complete search history.

(56) References Cited

U.S. PATENT DOCUMENTS 2,673,986 A * 4/1954 Schaefer ..... 4/255.01
3,789,861 A * 2/1974 Conn et al. ..... 134/166 C
4,674,137 A * 6/1987 Girse ..... 4/255.03
5,193,245 A 3/1993 Brzoska
5,664,284 A 9/1997 Brzoska
5,669,099 A * 9/1997 Porcasi ..... 15/341
5,775,743 A * 7/1998 Rochelle ..... 285/349
6,775,857 B2 * 8/2004 Hughes et al. ..... 4/255.04
6,941,613 B2 9/2005 Bryant
7,000,284 B1 * 2/2006 Sowden et al. ..... 15/314
7,160,395 B2 1/2007 Amos
2005/0028259 A1 2/2005 Buchanan et al.
2006/0225192 A1 10/2006 Williams

* cited by examiner

*Primary Examiner* — Len Tran
*Assistant Examiner* — James Hogan
(74) *Attorney, Agent, or Firm* — John F. A. Earley, III; Frank J. Bonini, Jr.; Harding, Earley, Follmer & Frailey, P.C.

(57) ABSTRACT

A vacuum drainage system for unclogging a clogged drain comprises a source of vacuum, a hose having a proximal end portion and a distal end portion, the proximal end portion of the hose being connected to the source of vacuum when the system is in use, and a drain clean-out device being received on the distal end portion of the hose when the system is in use. The drain clean-out device comprises a hollow tubular structure, a sealing member receiving portion located on the exterior surface of the hollow tubular structure at the first end portion of the structure, and a sealing member mountable on the sealing member receiving portion for creating a seal between the sealing member and the exterior service of the structure and between the sealing member and a clogged drain when the hollow tubular structure, with the sealing member mounted thereon, is positioned over a clogged drain, with the sealing member being in contact with an entrance to the drain or with a surface surrounding the entrance to the drain.

12 Claims, 2 Drawing Sheets

VACUUM DRAINAGE SYSTEM FOR UNCLOGGING A CLOGGED DRAIN, DRAIN CLEAN-OUT DEVICE THEREFOR, AND METHOD OF UNCLOGGING A CLOGGED DRAIN

BACKGROUND OF THE INVENTION

1. Field of the Invention

This invention relates to equipment and methods for unclogging a clogged drain, and more particularly concerns a vacuum drainage system for unclogging a clogged drain, a drain clean-out device of a vacuum drainage system for unclogging a clogged drain, and a method of unclogging a clogged drain using the vacuum drainage system and the drain clean-out device thereof.

2. Description of the Prior Art

A clogged drain is not only an inconvenience since it often prevents the sink, bathtub, shower, or the like to which it is connected from being used until the drain is unclogged, it can be a major problem on a commercial level. For example, an out-of-commission sink caused by a clogged drain in a restaurant's bathroom may prevent the restaurant's customers and staff from washing up, and an out-of-commission sink caused by a clogged drain in a restaurant's kitchen may hinder its staff from preparing meals. Also, for example, an out-of-commission sink or bathtub in a hotel room's bathroom caused by a clogged drain makes for an unhappy hotel guest. Further, a clogged drain often requires a plumber to unclog it, which is often expensive, and use of the sink, bathtub, shower, or the like to which the clogged drain is connected may be hindered for an extended period of time due to the clogged drain if a plumber is not immediately available.

Commercially available chemical drain cleaners (e.g., DRANO™) are a popular alternative to having a plumber unclog a clogged drain. However, such products use harsh chemicals and potentially may not be environmentally friendly (e.g., "green"). In rural areas, especially farming areas, where septic systems, as opposed to public sewer systems, are used, it is not advisable to use chemical drain cleaners to unclog drains because the chemical drain cleaners may adversely effect (e.g., damage) the septic systems. Further, if the runoff from septic systems contains chemical drain cleaners used on drains connected to the septic systems, crops may be damaged by such runoff and wells may be polluted by such runoff.

SUMMARY OF THE INVENTION

It is an object of the invention to provide a vacuum drainage system for unclogging a clogged drain, a drain clean-out device of a vacuum drainage system for unclogging a clogged drain, and a method of unclogging a clogged drain using the vacuum drainage system and the drain clean-out device thereof.

It is a further object of the invention to provide a vacuum drainage system and a method of unclogging a clogged drain using the vacuum drainage system that is not dependant upon the use of harsh chemicals to dissolve clogging debris formed in a clogged drain.

Further, it is an object of the invention to provide an inexpensive and quick-working method of unclogging a clogged drain.

These and other objects are accomplished by my invention which is described below.

DETAILED DESCRIPTION

Figures 4, 5, 6:
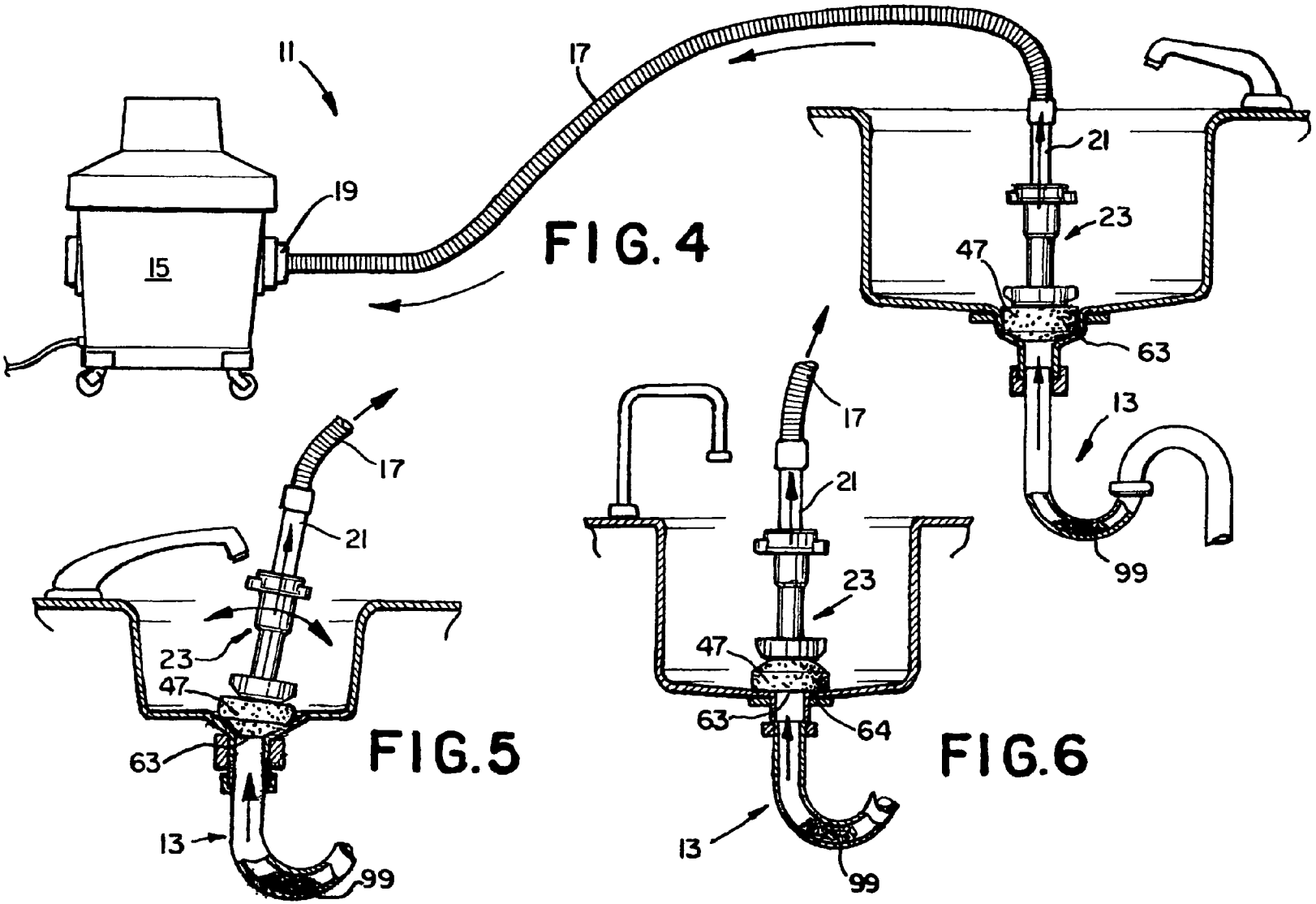
FIG. 4 is a schematic drawing of a vacuum drainage system, constructed in accordance with the invention, for unclogging a clogged drain, illustrating the vacuum drainage system in use to unclog a clogged drain.
FIG. 5 shows the inventive drain clean-out device in use, illustrating how the drain clean-out device may be tilted to create sufficient clearance away from a stationary faucet that may otherwise interfere with positioning the drain clean-out device over the drain opening.
FIG. 6 is another view of the drain clean-out device in operation, illustrating the option of the sealing member of the drain clean-out device in contact with the surface surrounding the entrance to the drain, as opposed to the option of the sealing member being in contact with the entrance to the drain as illustrated in FIG. 4.

Turning to the drawings, there are shown in FIG. 4 a vacuum drainage system 11, constructed in accordance with the invention, for unclogging a clogged drain 13 (e.g., a sink drain, a bathtub drain, a shower drain, or the like).

The vacuum drainage system 11 has a first source of vacuum 15, such as a standard industrial or residential vacuum cleaner (e.g., a SHOP-VAC™ vacuum cleaner) capable of vacuuming liquids, which is often referred to as a "wet vac".

The source of vacuum 15 (e.g., the wet vac) has a hose 17 having a proximal end 19 adapted and configured to be attached to the source of vacuum 15, and a distal end 21, such that objects, including liquids, may be pulled into the hose 17 at its distal end 21 and through the hose 17 to the source of vacuum 15 (e.g., the wet vac).

The vacuum drainage system 11 also has a drain clean-out device 23. The device 23, when in use, is received on the distal end 21 of the hose 17 as is described in further detail below.

Figure 1:
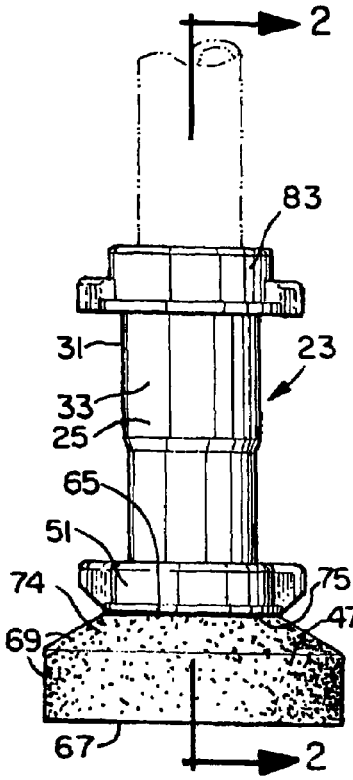
FIG. 1 is a view in front elevation showing a drain clean-out device, constructed in accordance with the invention, of a vacuum drainage system for unclogging a clogged drain.
Figure 2:
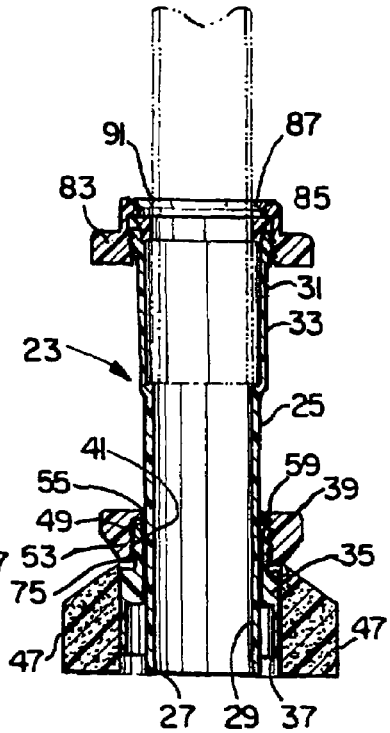
FIG. 2 is a view in cross section taken along the lines and arrows 2-2 shown in FIG. 1.
Figure 3:
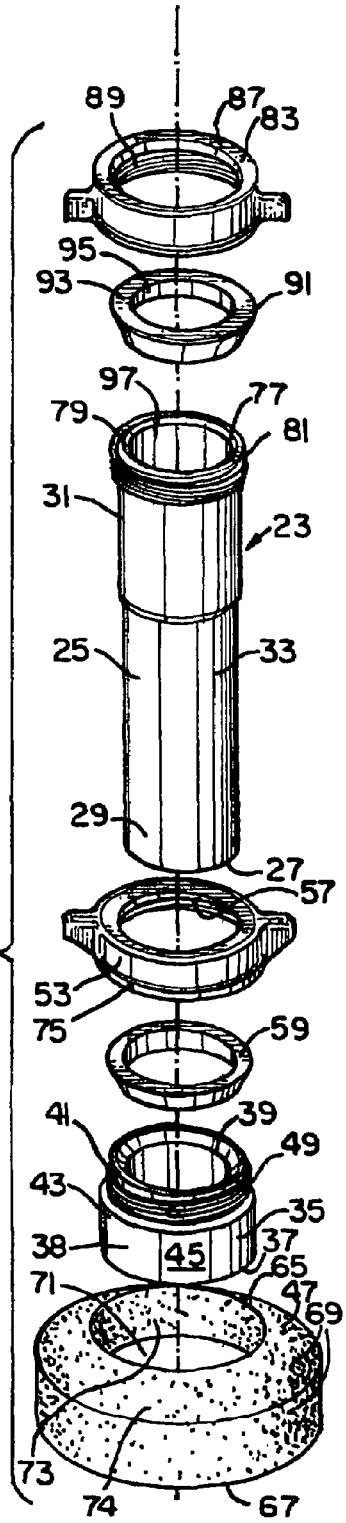
FIG. 3 is an exploded view of the drain clean-out device shown in FIG. 1.

In the preferred embodiment of the inventive drain clean-out device 23, illustrated and described herein and shown in detail in FIGS. 1-3, the device 23 includes a hollow tube 25 having a first end 27, a first end portion 29, a second end portion 31, and an exterior surface 33.

The preferred embodiment of the device 23 preferably also includes a hollow tubular adapter 35 that has a first end 37, a first end portion 38, a second end 39, a second end portion 41, and an exterior surface 43. The first end portion 38 of the adapter 35 forms a sealing member receiving portion 45 for receiving a sealing member 47 discussed in detail below.

The exterior surface 43 on the second end portion 41 of the adapter 35 has threading 49 formed thereon.

The preferred embodiment of the device 23 shown in the drawings also has a first jam nut 51 that has a nut wall 53 and a flange 55 extending inwardly from the nut wall 53. The nut wall 53 has a portion 57 that is threaded for engaging the threading 49 on the exterior surface 43 of the adapter 35.

In the preferred embodiment of the invention show in the drawings, a first washer 59 is secured around the exterior surface 33 of the hollow tube 25 near the first end portion 29 of the hollow tube 25.

The adapter 35 may be secured to the first end portion 29 of the hollow tube 25 by threading the first jam nut 51 onto the threading 49 on the exterior surface 43 of the adapter 35 such that the second end 39 of the adapter 35 and the flange 55 of the first jam nut 51 are pulled together into contact with the first washer 59, resulting in the first washer 59 being sandwiched between the second end 39 of the adapter 35 and the flange 55 of the first jam nut 51.

The sealing member 47 is mountable on the sealing member receiving portion 45 for creating a seal between the sealing member 47 and the exterior surface 43 of the adapter 35 and between the sealing member 47 and a clogged drain 13 when the device 23 is positioned over a clogged drain 13, with the sealing member 47 being in contact with an entrance 63 to the drain 13 (as is shown in FIG. 4) or with a surface 64 surrounding the entrance 63 to the drain 13 (as is shown in FIGS. 5 and 6).

The sealing member 47 in this preferred embodiment of the invention comprises a "tank to bowl" washer for a toilet, and is preferably made of soft rubber. The sealing member 47 has a substantially cylindrical shape having a first end 65, a second end 67, and an outer side wall 69 extending between the first end 65 and the second end 67. The sealing member 47 has a central hole 71 extending therethrough from the first end 65 of the sealing member 47 to the second end 67 of the sealing member 47. The sealing member 47 also has a sealing surface 73 defined by the hole 71 at its periphery for engaging the sealing member receiving portion 45 when the sealing member 47 is in place on the sealing member receiving portion 45, the sealing member receiving portion 45 being placed within the cylindrical hole 71.

The outer side wall 69 at the first end 65 of the sealing member 47 preferably has a chamfered portion 74 to facilitate matching the contour of the entrance 63 of some drains 13 such as the drain 13 shown in FIG. 4. The sealing member 47 may be positioned on the sealing receiving member 45 such that its first end 65 faces downwardly when the sealing member 47 is mounted on the adapter 35 to facilitate contact between the sealing member 47 and the entrance 63 to the drain 13 as is shown in FIG. 4. However, the sealing member 47 may be positioned on the sealing receiving member 45 such that the second end 67 faces downwardly when it is desired to contact the surface 64 surrounding the drain 13 with the sealing member 47 as is shown in FIGS. 5 and 6.

Surrounding the hollow tube 25 is a shoulder 75 created by the bottom portion of the nut wall 53 of the first jam nut 51 when the first jam nut 51 is threaded onto the threading 49 on the exterior surface 43 of the adapter 35. The shoulder 75 blocks upward movement of the sealing member 47 on the device 11 beyond the shoulder 75.

Preferably, as is shown in FIGS. 2 and 3, the device 23 also has a rim 77 formed at the second end 79 of the hollow tube 25, and has threading 81 formed on the exterior surface 33 of the hollow tube 25 near the second end 79 of the hollow tube 25.

Preferably, as is shown in the drawings, especially in FIGS. 1-3, the device 23 also has a second jam nut 83 that has a nut wall 85 and a flange 87 extending inwardly from the nut wall 85. The nut wall 85 has a portion 89 that is threaded for engaging the threading 81 on the exterior surface 33 of the hollow tube 25.

Preferably, a second washer 91 is positioned on the rim 77 of the hollow tube 25 and has a portion 93 that extends inwardly beyond the rim 77 of the hollow tube 25.

A seal is created when the flange 87 of the second jam nut 83 presses the second washer 91 against the rim 77 of the hollow tube 25 when the second jam nut 83 is threaded onto the threading 81 on the exterior surface 33 of the hollow tube 25 near the second end 79 of the hollow tube 25 sealing between the flange 87 and the rim 77. Further, the portion 93 of the second washer 91 has a sealing surface 95 for creating a press-fit seal between the sealing surface 95 and the distal end 21 of the vacuum hose 17 when the distal end 21 of the vacuum hose 17 is inserted into the second end 79 of the hollow tube 25.

In use, a source of vacuum 15 (e.g., a wet vac), the inventive drain clean-out device 23, and a vacuum hose 17 having a proximal end 19 connected to the source of vacuum 15 are provided for use in unclogging a clogged drain 13. The device 23 is positioned over a clogged drain 13, with the sealing member 47 being in contact with the entrance 63 of the drain 13 (as is shown in FIG. 4) or with the surface 64 surrounding the entrance 63 of the drain 13 (as is shown in FIGS. 5 and 6). The distal end 21 of the vacuum hose 17 is inserted into the second end 79 of the hollow tube 25 and into sealing contact with the device 23 by being press-fit against preferably the sealing surface 95 of the second washer 91 or by being press-fit against the interior surface 97 of the hollow tube 25 if the second washer 91 is removed and the second jam nut 83 is provided (such as when the distal end 21 of the hose 17 is on the larger size). Also, the distal end 21 of the vacuum hose 17 may be inserted into the second end 79 of the hollow tube 25 first, and the device 23 then placed firmly over the drain 13.

Then, with the source of vacuum 15 (e.g., the wet vac), the vacuum hose 17, and the device 23 connected together, the device 23 positioned over the drain 13, and any overflow hole (e.g., a sink or bathtub overflow hole) associated with the drain 13 covered or closed, the source of vacuum 15 (e.g., the wet vac, preferably with its paper filter removed) is used to pull by vacuum force and withdraw clogging debris 99 from the clogged drain 13 into and through the adapter 35, the hollow tube 25, and the vacuum hose 17 to the source of vacuum 15, thereby unclogging the drain 13. For double and triple sinks, all of the drains 13 but the clogged drain 13 are closed before unclogging the clogged drain 13.

Preferably, the first washer 59 and the second washer 91 are made of a suitable polymer or rubber material, such that the washers 59 and 91 are capable of being secured in place on the hollow tube 25. Also, the hollow tube 25, the jam nuts 51 and 83, and the adapter 35 preferably are made of a suitable polymer material.

Regarding the preferred embodiment of the invention shown in the drawings, the component parts of the device 23 are stock items available from hardware stores, which eliminates the necessity of creating new molds to create the component parts of the device 23. However, other embodiments of the invention may be made from specifically designed molds therefor.

As is illustrated in FIG. 5, the hollow tubular structure comprising the combination of hollow tub 25 and the adapter 35 may be tilted to avoid a faucet or the like that is fixed in place and blocks the device 23 from being positioned in a single straight line orientation above the drain 13. Even in a tilted position, such as that shown in FIG. 5, the seal between the adapter 35 and the sealing member 47 is maintained to permit the vacuum drainage system 11 to function.

The method of unclogging a clogged drain in accordance with the invention is environmentally friendly (e.g., "green") and it requires no caustic chemicals to dissolve the clogging debris clogging the drain 13.

The invention also is useful in retrieving objects (e.g., jewelry and the like) which mistakenly fall into a drain. Such objects now may be pulled by vacuum force from the drain 13 using the invention.

The invention claimed is:

1. A drain clean-out device of a vacuum drainage system for unclogging a clogged drain, comprising a hollow tubular structure having a first end, a first end portion, a second end, and an exterior surface, a sealing member receiving portion located on the exterior surface of the hollow tubular structure at the first end portion of the structure, and a sealing member mountable on the sealing member receiving portion for creating a seal between the sealing member and the exterior service of the structure and between the sealing member and a clogged drain when the structure, with the sealing member mounted thereon, is positioned over a clogged drain, with the sealing member being in contact with an entrance to the drain or with a surface surrounding the entrance to the drain, the hollow tubular structure being adapted to receive an end portion of a vacuum hose of the vacuum drainage system, the hollow tubular structure having a rim formed at the second end of the structure, the exterior surface of the hollow tubular structure being threaded near the second end of the structure, the device further including a jam nut having a nut wall and a flange extending inwardly from the nut wall, the nut wall having a portion that is threaded for engaging the threaded exterior surface of the hollow tubular structure near the second end of the structure, a washer positioned on the rim of the hollow tubular structure and having a portion that extends inwardly beyond the rim of the structure, a seal created when the flange of the jam nut presses the washer against the rim of the hollow tubular structure when the jam nut is threaded onto the threaded exterior surface of the structure near the second end of the structure sealing between the flange and the rim, and a sealing surface formed on the portion of the washer extending inwardly beyond the rim of the hollow tubular structure for creating a press-fit seal between the sealing surface and a vacuum hose of the vacuum drainage system when the vacuum.

2. The device of claim 1, further including an outwardly extending shoulder formed on the first end portion of the hollow tubular structure above the sealing member receiving portion of the hollow tubular structure for blocking upward movement of the sealing member on the hollow tubular structure beyond the shoulder.

3. The device of claim 1, the exterior surface of the hollow tubular structure being threaded near the first end of the hollow tubular structure, the device further including a jam nut having a portion that is threaded for engaging the threaded exterior surface of the hollow tubular structure near the first end of the structure, the jam nut having a bottom portion, and a shoulder created on the hollow tubular structure by the bottom portion of the jam nut when the jam nut is threaded onto the exterior surface of the hollow tubular structure near the first end of the structure, the shoulder blocking upward movement of the sealing member on the hollow tubular structure beyond the shoulder.

4. The device of claim 1, the sealing member having a substantially cylindrical shape having a first end, a second end, and an outer side wall extending between the first end and the second end, the sealing member having a central hole extending therethrough from the first end of the sealing member to the second end of the sealing member, the sealing member having a sealing surface defined by the hole at its periphery for engaging the sealing member receiving portion when the sealing member is in place on the sealing member receiving portion, the sealing member receiving portion being placed within the cylindrical hole, the outer side wall of the sealing member at the first end of the sealing member being chamfered, and the sealing member being positionable on the sealing receiving member such that its second end faces downwardly when it is desired to contact the surface surrounding the drain with the sealing member and its first end faces downwardly when it is desired to contact the entrance to the drain.

5. The device of claim 1, the hollow tubular structure including a hollow tube having a first end portion and a second end portion, a hollow tubular adapter having a first end, a first end portion, a second end portion, and an exterior surface, the first end portion of the adapter comprising the sealing member receiving portion, threading on the exterior surface of the adapter at the second end portion of the adapter, a jam nut having a nut wall and a flange extending inwardly from the nut wall, the nut wall having a portion that is threaded for engaging the threading on the exterior surface of the adapter, a washer secured around the exterior surface of the hollow tube near the first end portion of the hollow tube, the adapter being secured to the first end portion of the hollow tube when the jam nut is threaded onto the threading on the exterior surface of the adapter such that the second end of the adapter and the flange of the jam nut are pulled together into contact with the washer, and a shoulder surrounding the hollow tube created by the jam nut when the jam nut is threaded onto the threading of the exterior surface of the adapter, the shoulder blocking upward movement of the sealing member on the device beyond the shoulder.

6. A drain clean-out device of a vacuum drainage system for unclogging a clogged drain, comprising a hollow tube having a first end, a first end portion, a second end, a second end portion, and an exterior surface, the hollow tube being adapted to receive an end portion of a vacuum hose of the vacuum drainage system, a hollow tubular adapter having a first end, a first end portion, a second end portion, and an exterior surface, the first end portion of the adapter comprising a sealing member receiving portion, threading on the exterior surface of the adapter at the second end portion of the adapter, a first jam nut having a nut wall and a flange extending inwardly from the nut wall, the nut wall having a portion that is threaded for engaging the threading on the exterior surface of the adapter, a first washer secured around the exterior surface of the hollow tube near the first end portion of the hollow tube, the adapter being secured to the first end portion of the hollow tube when the first jam nut is threaded onto the threading on the exterior surface of the adapter such that the second end of the adapter and the flange of the first jam nut are pulled together into contact with the first washer, a sealing member mountable on the sealing member receiving portion for creating a seal between the sealing member and the exterior surface of the adapter and between the sealing member and a clogged drain when the device is positioned over a clogged drain, with the sealing member being in contact with an entrance to the drain or with a surface surrounding the entrance to the drain, and a shoulder surrounding the hollow tube created by the first jam nut when the first jam nut is threaded onto the threading on the exterior surface of the adapter, the shoulder blocking upward movement of the sealing member on the device beyond the shoulder.

7. The device to claim 6, further including a rim formed at the second end of the hollow tube, threading on the exterior surface of the hollow tube near the second end of the hollow tube, a second jam nut having a nut wall and a flange extending inwardly from the nut wall, the nut wall having a portion that is threaded for engaging the threading on the exterior surface of the hollow tube near the second end of the hollow tube, a second washer positioned on the rim of the hollow tube and having a portion that extends inwardly beyond the rim of the hollow tube, a seal created when the flange of the second jam nut presses the second washer against the rim of the hollow tube when the second jam nut is threaded onto the threading on the exterior surface of the hollow tube near the second end of the hollow tube sealing between the flange and the rim, and a sealing surface formed on the portion of the second washer extending inwardly beyond the rim of the hollow tube for creating a press-fit seal between the sealing surface and a vacuum hose of the vacuum drainage system when the vacuum hose is inserted into the second end of the hollow tube.

8. The device of claim 7, the sealing member having a substantially cylindrical shape having a first end, a second end, and an outer side wall extending between the first end and the second end, the sealing member having a central hole extending therethrough from the first end of the sealing member to the second end of the sealing member, the sealing member having a sealing surface defined by the hole at its periphery for engaging the sealing member receiving portion when the sealing member is in place on the sealing member receiving portion, the sealing member receiving portion being placed within the cylindrical hole, the outer side wall of the sealing member at the first end of the sealing member being chamfered, and the sealing member being positionable on the sealing receiving member such that its second end faces downwardly when it is desired to contact the surface surrounding the drain with the sealing member and, its first end faces downwardly when it is desired to contact the entrance to the drain.

9. The device of claim 6, the sealing member having a substantially cylindrical shape having a first end, a second end, and an outer side wall extending between the first end and the second end, the sealing member having a central hole extending therethrough from the first end of the sealing member to the second end of the sealing member, the sealing member having a sealing surface defined by the hole at its periphery for engaging the sealing member receiving portion when the sealing member is in place on the sealing member receiving portion, the sealing member receiving portion being placed within the cylindrical hole, the outer side wall of the sealing member at the first end of the sealing member being chamfered, and the sealing member being positionable on the sealing receiving member such that its second end faces downwardly when it is desired to contact the surface surrounding the drain with the sealing member and its first end faces downwardly when it is desired to contact the entrance to the drain.

10. A drain clean-out device of a vacuum drainage system for unclogging a clogged drain, comprising a hollow tubular structure having a first end, a first end portion, a second end, and an exterior surface, a sealing member receiving portion located on the exterior surface of the hollow tubular structure at the first end portion of the structure, and a sealing member mountable on the sealing member receiving portion for creating a seal between the sealing member and the exterior service of the structure and between the sealing member and a clogged drain when the structure, with the sealing member mounted thereon, is positioned over a clogged drain, with the sealing member being in contact with an entrance to the drain or with a surface surrounding the entrance to the drain, the hollow tubular structure being adapted to receive an end portion of a vacuum hose of the vacuum drainage system, the exterior surface of the hollow tubular structure being threaded near the first end of the hollow tubular structure, the device further including a jam nut having a portion that is threaded for engaging the threaded exterior surface of the hollow tubular structure near the first end of the structure, jam nut having a bottom portion, and a shoulder created on the hollow tubular structure by the bottom portion of the jam nut when the jam is threaded onto the exterior surface of the hollow tubular structure near the first end of the structure, the shoulder blocking upward movement of the sealing member on the hollow tubular structure beyond the shoulder.

11. The device of claim 10, the sealing member having a substantially cylindrical shape having a first end, a second end, and an outer side wall extending between the first end and the second end, the sealing member having a central hole extending therethrough from the first end of the sealing member to the second end of the sealing member, the sealing member having a sealing surface defined by the hole at its periphery for engaging the sealing member receiving portion when the sealing member is in place on the sealing member receiving portion, the sealing member receiving portion being placed within the cylindrical hole, the outer side wall of the sealing member at the first end of the sealing member being chamfered, and the sealing member being positionable on the sealing receiving member such that its second end faces downwardly when it is desired to contact the surface surrounding the drain with the sealing member and its first end faces downwardly when it is desired to contact the entrance to the drain.

12. The device of claim 10, the hollow tubular structure including a hollow tube having a first end portion and a second end portion, a hollow tubular adapter having a first end, a first end portion, a second end portion, and an exterior surface, the first end portion of the adapter comprising the sealing member receiving portion, threading on the exterior surface of the adapter at the second end portion of the adapter, a jam nut having a nut wall and a flange extending inwardly from the nut wall, the nut wall having a portion that is threaded for engaging the threading on the exterior surface of the adapter, a washer secured around the exterior surface of the hollow tube near the first end portion of the hollow tube, the adapter being secured to the end portion of the hollow tube when the jam nut is threaded onto the threading on the exterior surface of the adapter such that the second end of the adapter and the flange of the jam nut are pulled together into contact with the washer, and a shoulder surrounding the hollow tube created by the jam nut when the jam nut is threaded onto the threading of the exterior surface of the adapter, the shoulder blocking upward movement of the sealing member on the device beyond the shoulder.

* * * * *